US005730093A

United States Patent [19]

Calka et al.

[11] Patent Number: 5,730,093

[45] Date of Patent: Mar. 24, 1998

[54] ROLLER ROCKER ARM

[75] Inventors: Andrzej Calka, Ancaster; Anthony G. Sytsma, Point Edward, both of Canada

[73] Assignee: Sandco Automotive Limited, Hamilton, Canada

[21] Appl. No.: 693,776

[22] Filed: Aug. 7, 1996

[51] Int. Cl.[6] ..... F01L 1/18

[52] U.S. Cl. ..... 123/90.39; 123/90.41; 74/519; 74/559; 29/888.2

[58] Field of Search ..... 123/90.39, 90.4, 123/90.41, 90.44, 90.45; 74/519, 559; 29/888.2

[56] References Cited

U.S. PATENT DOCUMENTS

| | | | |
|---|---|---|---|
| 2,176,083 | 10/1939 | Leake | 74/519 |
| 2,199,914 | 5/1940 | Haberstump | 74/519 |
| 2,272,166 | 5/1942 | Leake | 74/519 |
| 2,338,726 | 1/1944 | Leake | 74/519 |
| 2,345,822 | 4/1944 | Leake | 74/519 |
| 2,529,089 | 11/1950 | Leake | 74/519 |
| 2,905,160 | 9/1959 | Sampietro | 123/90 |
| 3,096,749 | 7/1963 | Davidson | 123/90.39 |
| 3,251,350 | 5/1966 | Thompson | 123/90.41 |
| 3,410,366 | 11/1968 | Winter, Jr. | 184/6 |
| 3,621,823 | 11/1971 | Lombardi | 123/90.42 |
| 4,245,523 | 1/1981 | Wherry | 74/579 |
| 4,796,483 | 1/1989 | Patel et al. | 29/888.2 |
| 4,825,717 | 5/1989 | Mills | 29/888.2 |
| 4,878,463 | 11/1989 | Fredericksen et al. | 123/90.41 |
| 4,940,048 | 7/1990 | Mills | 123/90.41 |
| 4,944,257 | 7/1990 | Mills | 123/90.41 |
| 5,016,582 | 5/1991 | Mills | 123/90.41 |
| 5,048,475 | 9/1991 | Mills | 123/90.41 |
| 5,123,384 | 6/1992 | Abbas | 123/90.39 |
| 5,195,475 | 3/1993 | Murphy et al. | 123/90.39 |

*Primary Examiner*—Weilun Lo
*Attorney, Agent, or Firm*—Rogers & Scott

[57] ABSTRACT

The invention provides a rocker arm and a method of making it having a cold formed steel body including parallel side walls and a bearing housing in the form of a sleeve attached to the side walls and defining a through opening to receive needle bearings. The sleeve has surfaces resistant to gas hardening so that after the arm has been subject to gas hardening only the main body is hardened leaving the sleeve unaffected. A method of making the rocker arm according to the invention includes preparing a sleeve having a surface which is resistant to gas hardening and which is unaffected by brazing temperatures; attaching the sleeve to the arm by brazing; and gas hardening the completed arm at a temperature less than the brazing temperature.

16 Claims, 2 Drawing Sheets

ROLLER ROCKER ARM

FIELD OF THE INVENTION

This invention relates to rocker arms of the type used in internal combustion engines to actuate poppet valves using push rods, and more particularly to such a rocker arm made by cold forming a blank.

BACKGROUND OF THE INVENTION

Rocker arms in some form have always been an integral part of internal combustion engines which use poppet valves. The type of arm used depends on the layout of the engine. When a remote camshaft is used, a pushrod is required between the camshaft and the rocker, whereas when the camshaft is positioned to operate directly on the arm, there is no pushrod. In the latter case the arm is more commonly called a "finger follower".

The present invention is directed to a rocker arm of the type used to transfer motion from a push rod to a poppet valve.

Rocker arms are responsible for part of the energy losses in an engine. There are two primary causes of such losses. Firstly, the arm is accelerated from rest by the push rod and, as the arm rocks, a return spring on the associated poppet valve is compressed thereby storing energy for use subsequently to return the arm to the original position with the valve dosed. Clearly, because this energy is minimized if the rotational moment of inertia of the arm is reduced, arms have been designed both to minimize weight at the ends of the rocker arm and to obtain the desired rigidity and strength using a minimum of material.

A second source of energy loss is in the bearing which permits the arm to rock. Originally simple journal bearings were used and these have given way to sophisticated needle bearings which permit movement with very little resistance and which continue to perform well over the life of the engine.

Another important characteristic of a cold formed rocker arm is the need to harden the arm to provide both a wear resistant seat for the push rod and a pad on the arm used to push the valve. This hardening is most readily done in conventional fashion in a gas chamber so that the whole of the arm is hardened. Such a process is the most cost effective way of handling the arm and as a result is commonly used.

An example of a typical rocker arm is seen in U.S. Pat. No. 2,338,726 to Leake which issued in 1944. This arm is generally of the "boat-shaped" type currently preferred because of the strength it provides while exhibiting a reasonable angular moment of inertia. However, the patent teaches a simple journal bearing which would exhibit significant frictional losses which would result in wear and increased losses as the engine ages. An alternative structure having similar limitations is found in U.S. Pat. No. 2,345,822 also to Leake.

As manufacturing techniques improved, various designs evolved. One such structure is shown in U.S. Pat. No. 3,096,749 which also included a journal bearing.

In 1966 U.S. Pat. No. 3,251,350 taught the use of an arm which incorporated two needle bearings arranged to sit in a shaped depression in the bottom wall of a boat-shaped arm. While this structure exhibited reduced friction as it rocked, the design required accurate shaping of the arm to receive the needle bearings. This is a disadvantage because the hardening process always results in some deformation which in this design must be accepted as part of the finished product. Similar structures are shown in U.S. Pat. Nos. 3,621,823; 4,878,463 and Re 33,870.

A different approach to including needle bearings is found in U.S. Pat. Nos. 4,940,027 and 4,944,257 which issued in 1990. In this design a boat-shaped body has walls deformed to provide bearing housings into which the bearings are inserted. This design also has a disadvantage. The openings in the side walls reduce the strength of these walls where the bending moment is at a maximum. As a result, if the wails are to be rigid, the material must be thickened and this increases the weight of the arm and hence the angular moment of inertia.

U.S. Pat. No. 5,123,384 also includes needle bearings in a rocker arm. This design is a hybrid of earlier designs in that a sleeve which acted as a simple journal bearing in earlier designs is modified to receive two needle bearings. The sleeve (or bearing housing) is of steel which is fitted into openings in the side walls and brazed in place. Subsequently the complete arm is hardened which will inevitably harden the sleeve and cause some distortion in the assembly. This is accommodated by machining the bore after positioning the arm accurately relative to datum points at the push rod seat and at the valve pad. Such machining requires specialized equipment because the surface is hardened.

A further disadvantage in this design is that the structure lacks resilience and the repetitive loading and unloading during prolonged use can result in the development of cracks.

It is among the objects of the present invention to provide a rocker arm having cold formed rocker arm body assembled with a bearing housing to receive needle bearings and which does not suffer from disadvantages created by gas hardening the assembled rocker arm.

SUMMARY OF THE INVENTION

The invention provides a rocker arm having a cold formed steel body including parallel side walls and a bearing housing in the form of a sleeve attached to the side walls and defining a through opening to receive needle bearings. The sleeve has surfaces resistant to gas hardening so that after the arm has been subject to gas hardening only the main body is hardened leaving the sleeve unaffected.

A method of making the rocker arm according to the invention includes preparing a sleeve having a surface which is resistant to gas hardening and which is unaffected by brazing temperatures; attaching the sleeve to the arm by brazing; and gas hardening the completed arm at a temperature less than the brazing temperature.

BRIEF DESCRIPTION OF THE PREFERRED EMBODIMENTS

Figure 1:
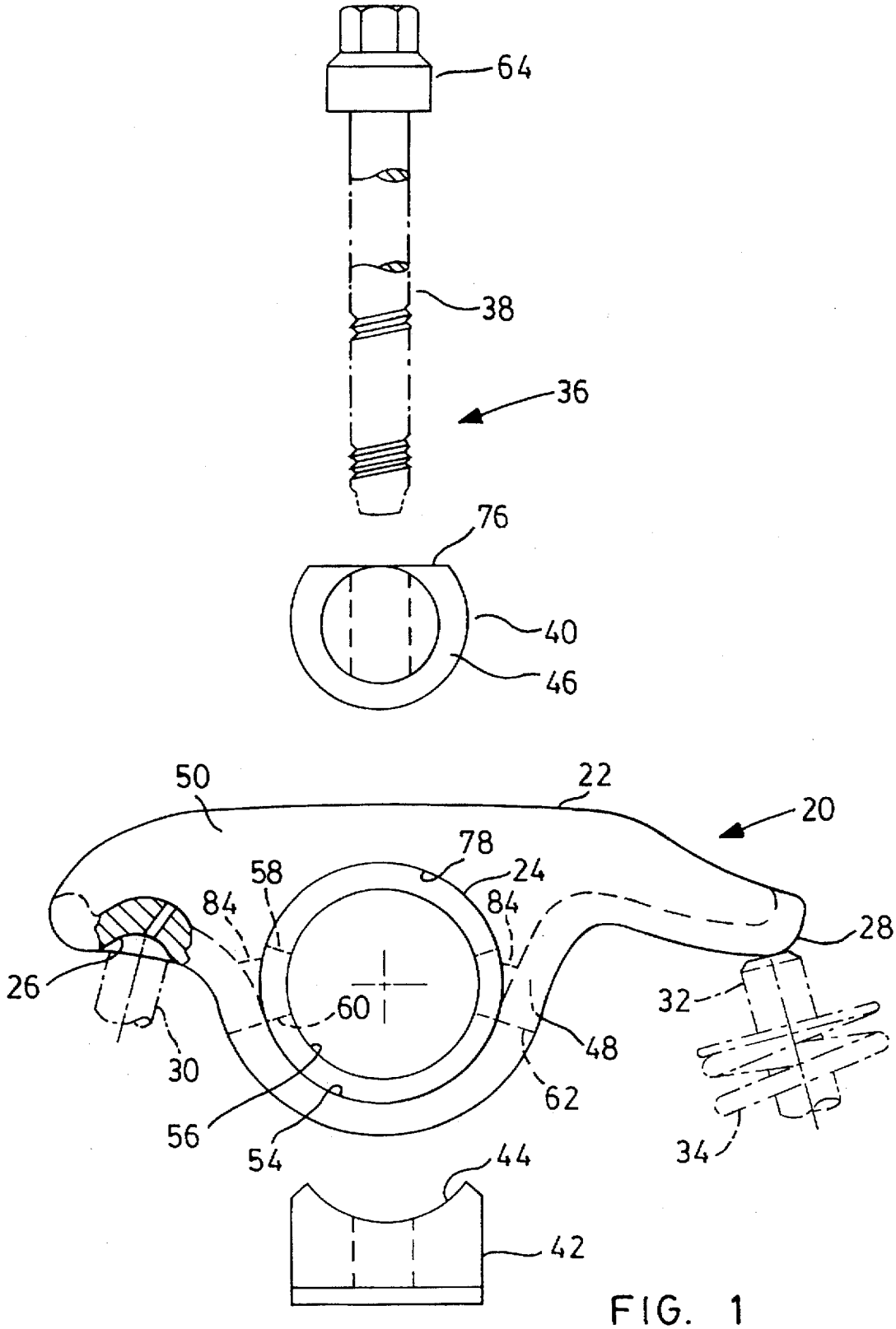
FIG. 1 is an exploded side view showing a rocker arm according to a preferred embodiment of the invention and parts used in assembling the rocker arm on a cylinder head, but excluding needle bearing assemblies.

Reference is made to FIG. 1 which illustrates a rocker arm according to a preferred embodiment of the invention and indicated generally by the numeral 20. The rocker arm consists essentially of a main body 22 and a bearing housing 24 attached to the main body as will be described. A first end of the main body defines a push rod seat 26 and a second end defines a pad 28. A push rod 30 is shown in ghost outline to indicate the utility of the arm, and at the other end, part of a poppet valve 32 is shown in association with the usual compression spring, etc. 34. The structure of the arm will be described in more detail later in the description.

FIG. 1 also shows that the rocker arm in use is associated with a post designated generally by the numeral 36. The post consists of a bolt 38 which passes through a cylindrical stepped shaft 40 before also passing through a pillow block 42. An upper surface 44 is provided on the block 42 to engage a central part 46 of the stepped shaft 40. Details of this assembly will become apparent also with reference to subsequent views.

The stepped shaft 40 supports needle bearings (not shown in FIG. 1) which engage inside the bearing housing 24 arid the assembly is held in place on an engine cylinder head by the bolt 38 which engages in the cylinder head.

Figure 3:
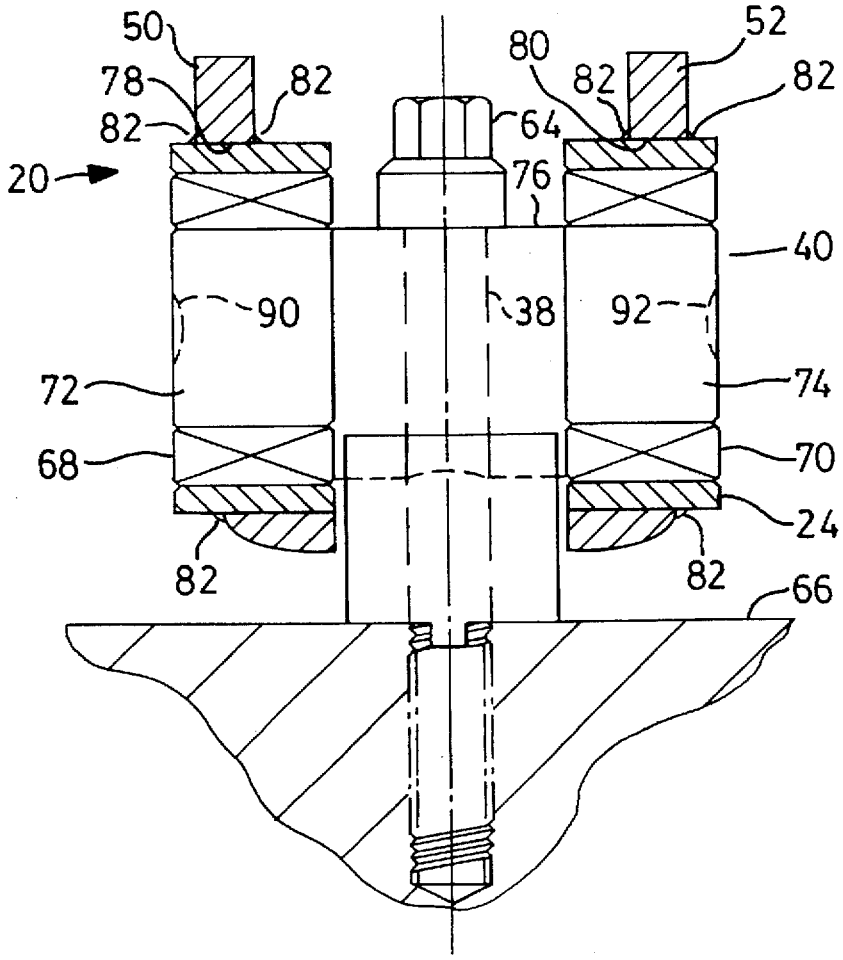
FIG. 3 is a sectional transverse view of the rocker arm shown with parts used in assembling the rocker arm on the cylinder head and drawn to a larger scale than that used in FIG. 1, the assembly including needle bearings.

The rocker arm 20 is typical of rocker arms known as "boat-shaped" rocker arms which are so named because they are open at the top and are defined essentially by a bottom wall 48 and a peripheral wall which includes a pair of side walls 50 and 52 (FIG. 3). As seen in FIG. 1, the bottom wall 48 has a downwardly extending recess 54 having a generally cylindrical shape to receive the outer surface of the cylindrical bearing housing 24. This is the preferred shape of bearing housing which can of course take any shape consistent with fitting within the arm 20. However, the internal surface 56 is preferably round in cross-section since it receives needle bearings as will be described.

Figure 2:
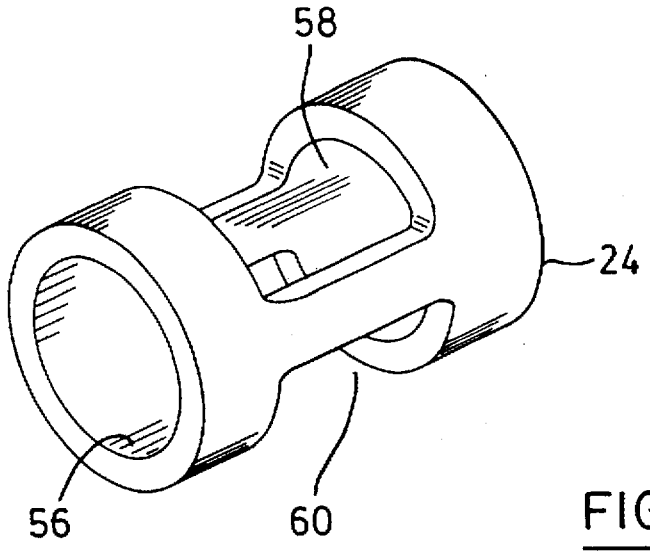
FIG. 2 is an isometric view of a bearing housing used in the rocker arm.

Reference is next made to FIG. 2 which more fully describes the bearing housing 24. It will be seen that the housing is a sleeve having upper and lower apertures 58, 60 cut out from the sleeve to accommodate the post 36. Similarly, as seen in FIGS. 1 and 3, the bottom wall 48 of the rocker arm 20 defines a bottom aperture 62 which is in effect a continuation of the lower aperture 60 of the bearing housing 24. The apertures 60, 62 are proportioned to provide clearance for the pillow block 42 as the rocker arm rocks between valve closed and valve open positions. Similarly, the upper aperture 58 in the bearing housing 24 provides clearance for a head 64 on the bolt 38.

Reference is next made to FIG. 3 which illustrates the rocker arm 20 in an assembly. Here it will be seen that the bolt 38 has been used to hold the assembly on an exemplary cylinder head 66. The bearing housing 24 receives a pair of needle bearings 68, 70 which are illustrated diagrammatically in the view. These bearings are a sliding fit on stub axles 72, 74 forming part of the stepped shaft 40. As seen in FIGS. 1 and 3, the central part 46 of the stepped shaft 40 defines a flat upper surface 76 to seat the head 64 of the bolt 38. Also, the underside of the central part 46 sits on the upper surface 44 of the pillow block for accurate and positive location of the whole assembly relative to the cylinder head 66.

The assembly and manufacture of the rocker arm 20 will be described followed by the assembly of the rocker arm in the relationship shown in FIG. 3.

The main body 22 is formed in conventional fashion using cold forming techniques. Subsequently, side openings 78, 80 are formed in the respective side walls 50, 52 and proportioned to receive the bearing housing 24. Also, in forming the main body 22, the bottom aperture 62 is formed to complete the general arrangement.

The bearing housing 24 is preferably made from a mild steel seamless tube cut to length and subsequently machined to define the upper and lower apertures 58, 60. The bearing housing is then plated with copper on all surfaces to provide a coating.

The openings 78, 80 in the side wails 50, 52 are proportioned to receive the finished bearing housing which is slipped into position where if preferred it can be retained in position by crimping locally at both ends of the housing. It is preferable to provide some positive location because the next step is to heat the parts for brazing the bearing housing in the body. The brazing step uses brazing preforms having a melting temperature somewhat below that of the copper plating on the bearing housing so that the heat of brazing will not cause melting of the copper plating. The two preforms are placed one to either side of the bearing housing 24 where the bearing housing meets the depression in the bottom wall of the rocker arm. When the temperature is elevated, the preforms melt and surface tension carries the liquid brazing around the bearing housing to form beads indicated at 82 in FIG. 3 and at 84 in FIG. 1.

The assembly is next gas heat treated to harden the rocker arm and particularly to harden the seat 26 for the push rod 30 and the pad 28 for the valve shaft 32. The treatment process is at a temperature less than the melting temperature of the brazing which, as mentioned, is less than the melting temperature of the copper plating on the bearing housing 24. As a result, the process will harden the main body 22 and have no effect on the bearing housing 24.

After hardening, the dimensions of the assembly must be finalized. This is done by locating the assembly in a jig and machining the opening 56 in the bearing housing 24 to provide the finished opening for the bearing 68, 70. The design is such that some material will be removed and the exact location of the material will depend on whether or not the bearing housing is misaligned, offset, or simply positioned where it requires a uniform skim to bring it to size. In any event, the machining can take care of all of these inaccuracies very simply because the process is removing a very thin layer of copper and some mild steel which has not been hardened.

Once the machining process is completed the rocker arm is ready for assembly. This is achieved by entering the stepped shaft 40 through the opening 56 in the bearing housing, positioning it and then engaging the bearings 68, 70 from either side of the arm 20. This intermediate assembly is completed by applying centrally concentrated end loads to the stepped shaft 40 to create dimples indicated in FIG. 3 by the numerals 90, 92. These dimples cause some radial deformation so that the stepped shaft engages the bearings 68, 70 and ensures that they will not separate in use. The bearings will not move towards one another because they are in engagement with the central part 46 of the stepped shaft.

The intermediate assembly next receives the bolt 38 through the stepped shaft 40 in which it is a relatively loose fit. The bolt then passes through the pillow block 42 which includes a retaining structure (not shown) so that the assembly will remain intact and be ready for attachment to the cylinder head 66 when desired.

In the preferred embodiment the copper coating is commercial copper (99.9% Cu) having a thickness of at least 0.0051 mm in order to minimize the risk of gas penetration during gas heat treatment. The liquidus of copper is about 1082 degrees C. and the brazing material is sold under the trademark CABRA #521 and has a liquidus of about 1027 degrees C. The gas heat treatment is carbonitriding having a maximum process temperature of about 893 degrees C.

It will be evident from the foregoing description that variations can be made to the structure within the scope of the invention. In particular, although the bearing housing 24 is preferably of a tubular sleeve-like construction, it could take a number of different forms. Similarly, instead of being steel with a copper plating, the material could be phosphor bronze or some other material which is not affected by gas hardening and which can be attached to the main body 22. Such variations are within the scope of the invention as described and claimed.

We claim:

1. A rocker arm having:

a cold formed body extending longitudinally between first and second ends and including generally parallel side walls defining transversely aligned openings, a bottom wall having a bottom aperture, a push rod seat adjacent said first end, and a pad at said second end;

a bearing housing fitted in the openings and exhibiting a surface finish which is unaffected by brazing temperatures, the bearing housing having upper and lower apertures aligned with the bottom aperture to receive a post assembly;

brazed joints between the main body and the bearing housing; and a gas hardened finish on the main body to provide a hardened surface to minimize wear in use at the push rod seat and the pad, the bearing housing having no gas hardened finish.

2. A rocker arm as claimed in claim 1 in which the bearing housing is a sleeve.

3. A rocker arm as claimed in claim 1 in which the bearing housing is a steel sleeve coated with copper having a melting point greater than said brazing temperature.

4. A rocker arm having:

a generally boat-shaped main body of steel extending longitudinally, the main body having a bottom wall and a pair of generally parallel side walls, the bottom wall defining a cylindrical recess extending transversely and a bottom aperture in the recess, the side walls defining side wall openings aligned transversely, and the body including a push rod seat and a valve pad;

a bearing housing of steel in the form of a sleeve passing through said side wall openings, the housing having upper and lower apertures, the lower aperture and said bottom aperture being aligned, the upper aperture, lower aperture and bottom aperture providing clearance to receive a part used to assemble the arm on a cylinder head;

the bearing housing having a thin copper coating over all surfaces of the housing; and brazed joints between the main body and the bearing housing, the material of the brazed joints having a melting temperature less than the melting temperature of said copper coating.

5. A rocker arm as claimed in claim 4 in which the main body is gas hardened.

6. A rocker arm as claimed in claim 4 in which the bearing housing rests on said depression in said bottom wall of the main body.

7. A method of manufacturing a rocker arm of the type used to transfer motion from a pushrod to a popper valve, the method including the steps:

cold forming a main body from a steel blank to include a cold formed body extending longitudinally between first and second ends and including generally parallel side walls defining transversely aligned openings, a bottom wall having a bottom aperture, a push rod seat adjacent said first end, and a pad at said second end;

providing a steel bearing housing adapted to fit in said openings and having upper and lower apertures;

coating the bearing housing in copper;

placing the bearing housing in the main body with said lower aperture and said bottom aperture aligned;

brazing the bearing housing to the main body at a temperature less than the melting temperature of the copper coating on the bearing housing to form an assembly;

gas hardening said assembly at a temperature below the brazing temperature whereby the body is surface hardened and the bearing housing is unaffected; and machining an opening in the bearing housing for receiving bearings.

8. A method as claimed in claim 7 in which the bearing housing is a sleeve.

9. In a rocker arm of the type having a cold formed body defining parallel side walls and a bearing housing extending through the side walls and attached to the side walls, the improvement in which the body is gas hardened and the bearing housing exhibits a surface which is unaffected by gas hardening so that the physical properties of the bearing housing are unaffected by the gas hardening whereby the rocker arm is less susceptible to cracking caused by respective loading.

10. A rocker arm having:

a gas hardened steel body extending longitudinally between first and second ends and including generally parallel side walls defining transversely aligned openings, a bottom wall having a bottom aperture, a push rod seat adjacent said first end, and a pad at said second end;

an unhardened bearing housing fitted in the openings and defining a transverse opening to receive bearings, the bearing housing having upper and lower apertures aligned with the bottom aperture to receive a post assembly; and brazed joints between the main body and the bearing housing.

11. A rocker arm as claimed in claim 10 in which the bearing housing is a sleeve.

12. A rocker arm as claimed in claim 10 in which the bearing housing is a steel sleeve coated with copper having a melting point greater than said brazing temperature and finish machined in said transverse opening for fitting the bearings, the finish machining having removed some or all of the copper in the transverse opening depending upon the tolerances of each rocker arm.

13. A rocker arm having:

a gas hardened main body of steel extending longitudinally, the main body having a bottom wall and a pair of generally parallel side walls, the bottom wall defining a cylindrical recess extending transversely and a bottom aperture in the recess, the side walls defining side wall openings aligned transversely, and the body including a push rod seat and a valve pad;

an unhardened bearing housing of steel in the form of a sleeve defining transverse opening and passing through said side wall openings, the housing having upper and lower apertures, the lower aperture and said bottom aperture being aligned, the upper aperture, lower aperture and bottom aperture providing clearance to receive a part used to assemble the arm on a cylinder head;

the bearing housing having a thin copper coating over all surfaces of the housing but for material removed after gas hardening to finish said transverse opening to receive bearings;

brazed joints between the main body and the bearing housing, the material of the brazed joints having a melting temperature less than the melting temperature of said copper coating.

14. A rocker arm as claimed in claim 13 in which the bearing housing rests on said depression in said bottom wall of the main body.

15. A method of manufacturing a rocker arm of the type used to transfer motion from a pushrod to a poppet valve, the method including the steps:

forming a main body from a steel blank, the body extending longitudinally between first and second ends and including generally parallel side walls defining transversely aligned openings, a bottom wall having a bottom aperture, a push rod seat adjacent said first end, and a pad at said second end;

providing a tubular bearing housing exhibiting a surface which is unaffected by gas hardening, the bearing housing being adapted to fit in said openings and having upper and lower apertures;

placing the bearing housing in the main body with said lower aperture and said bottom aperture aligned;

brazing the bearing housing to the main body to form an assembly;

gas hardening said assembly at a temperature below the brazing temperature whereby the body is surface hardened and the bearing housing is unaffected; and machining a transverse opening in the bearing housing for receiving bearings.

16. A method as claimed in claim 15 in which the bearing housing is a sleeve.

* * * * *